US007144851B2

(12) United States Patent
Kosub et al.

(10) Patent No.: US 7,144,851 B2
(45) Date of Patent: Dec. 5, 2006

(54) MULTI-PHASE LAUNDRY TABLETS AND METHODS FOR PRODUCING THEM

(75) Inventors: Mike Kosub, Bruchsal (DE); Roberto Casonati, Venezia - Mestre (IT)

(73) Assignee: Reckitt Benckiser N.V., Hoofddorp (NL)

( * ) Notice: Subject to any disclaimer, the term of this patent is extended or adjusted under 35 U.S.C. 154(b) by 56 days.

(21) Appl. No.: 10/311,940

(22) PCT Filed: Jun. 21, 2001

(86) PCT No.: PCT/GB01/02773

§ 371 (c)(1),
(2), (4) Date: Dec. 18, 2002

(87) PCT Pub. No.: WO01/98448

PCT Pub. Date: Dec. 27, 2001

(65) Prior Publication Data

US 2003/0119707 A1 Jun. 26, 2003

(30) Foreign Application Priority Data

Jun. 23, 2000 (GB) ..... 0015350.2

(51) Int. Cl.
*C11D 17/00* (2006.01)

(52) U.S. Cl. ..... 510/446; 510/224; 510/294; 510/298

(58) Field of Classification Search ..... 510/224, 510/446, 46, 298, 294
See application file for complete search history.

(56) References Cited

U.S. PATENT DOCUMENTS

| | | | | |
|---|---|---|---|---|
| 4,828,749 | A * | 5/1989 | Kruse et al. | 510/224 |
| 4,897,212 | A * | 1/1990 | Kruse et al. | 510/224 |
| 5,958,855 | A * | 9/1999 | Binstock et al. | 510/224 |
| 6,194,368 | B1 * | 2/2001 | Waschenbach et al. | 510/224 |
| 6,589,925 | B1 * | 7/2003 | Binstock et al. | 510/224 |
| 6,660,704 | B1 * | 12/2003 | Waschenbach et al. | 510/298 |
| 6,727,213 | B1 * | 4/2004 | Waschenbach et al. | 510/224 |
| 2002/0147125 | A1 | 10/2002 | Hoflinger et al. | 510/447 |

FOREIGN PATENT DOCUMENTS

| | | |
|---|---|---|
| EP | 0 976 819 | 2/2000 |
| EP | 1 043 390 | 11/2000 |
| EP | 1 090 980 | 4/2001 |
| GB | 911204 | * 11/1962 |
| WO | 99/27063 | 6/1999 |
| WO | WO 00/04116 A2 * | 1/2000 |
| WO | 00 52127 | 9/2000 |
| WO | 00 70008 | 11/2000 |

* cited by examiner

*Primary Examiner*—Lorna M. Douyon
(74) *Attorney, Agent, or Firm*—Norris McLaughlin & Marcus PA

(57) ABSTRACT

A multi-phase detergent tablet comprising:
a) a first phase having a planar upper surface, and
b) a second phase adhered to and partially covering the upper surface.

13 Claims, 1 Drawing Sheet

MULTI-PHASE LAUNDRY TABLETS AND METHODS FOR PRODUCING THEM

BACKGROUND OF THE INVENTION

The present invention relates to detergent tablets, particularly for use in a domestic dishwashing machine.

Detergent compositions are known. While these may be in the form of a liquid or free-flowing solid such as a powder, those in the form of a tablet are now generally available. Known tablets may be of a substantially uniform composition, or may be separated into two or more phases, for example to separate incompatible components from each other, to ensure that different components are released into the wash at different times, or to provide an attractive appearance, especially when the phases have different colours. These tablets may be used, for example, in a washing machine for laundry or a dishwashing machine.

Commercially available tablets are known which have two or more layers of a compressed, granular or powdery composition. A tablet is also known which has an insert or cavity filled with a composition containing a different component from the main phase. For example, we currently sell a dishwashing tablet which is a two-layer tablet containing a third composition in the form of a ball held within a cavity punched in the upper surface of the tablet. The ball has a different colour from the two layers, which provides an attractive appearance. The ball also contains a disrupting agent such that components in the ball are released into the wash before the components of the two layers of the tablet.

The layers of the tablet are formed by compression of particulate material. The cavity is formed by using any appropriately shaped upper punch, having a protrusion corresponding to the shape of the cavity.

The regions beneath and adjacent to the sides of the cavity are compressed to a greater extent than the rest of the tablet, creating an uneven distribution of densities within the tablet. As a consequence, the different portions of the tablet have undesirable different disintegration and solubilisation profiles. If the overall pressure of the upper punch used to form the cavity in the tablet is reduced, there may be an insufficient compression of the shoulders of the tablet. The tablet may then be easily damaged during storage and transport.

Furthermore it is necessary to place accurately the ball in the cavity. If it is not placed exactly in the cavity, the ball tends to disintegrate or break away from the remainder of the tablet. This leads to a high rate of wastage.

We have now discovered a tablet which retains the advantages of this type of tablet, such as an attractive appearance and separation of components into different phases, and which also overcomes the above disadvantages.

BRIEF SUMMARY OF THE INVENTION

The present invention provides a multi-phase detergent tablet comprising:

a) a first phase having a planar or generally planar upper surface, and b) a second phase adhered to and partially covering said upper surface.

The present invention also provides a process for preparing a tablet as defined above which comprises adhering the second phase to the first phase.

DETAILED DESCRIPTION OF THE INVENTION

Figure 1:
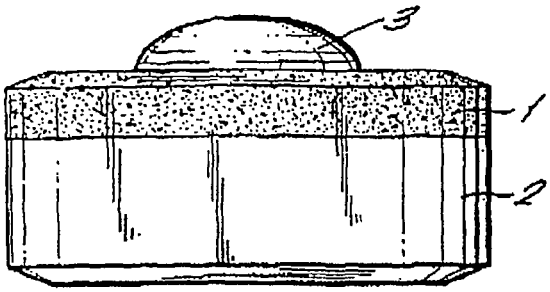
FIGS. 1 to 4 illustrate an example of a table according to the present invention.

The tablet of the present invention retains the advantages of the commercialised tablet. The second phase can easily be shaped to look like a ball protruding from the upper surface of the tablet. Furthermore the different phases can still contain incompatible components, or components which are desirably released into the wash at different times. Additionally, the second phase may, if desired, be formed into different shapes which could not easily be placed in a cavity. Since the second phase does not have to be precisely placed in a cavity, small variations in its positioning on the surface of the first phase do not matter. A slightly incorrectly placed second phase will not break away from the first phase. Furthermore, since the use of a punch to create the cavity during the moulding step is avoided, the first phase, or each layer in the first phase if there is more than one layer, can have a substantially uniform density and compression.

The first phase of the tablet can be of any shape so long as it has a planar or generally planar upper surface to which the second phase can be adhered. The first phase can have, for example, a circular, elliptical or rectangular cross-section. Desirably the tablet is in the form of a rectangular brick or cylinder. The first phase can be formed by compression, for example in a tablet press, of a powdery or granulated composition. The first phase may also be formed by, for example, casting or extrusion. The first phase may, if desired, comprise one or more layers of differing compositions, and may itself comprise one or more inserts of differing compositions.

The upper surface of the first phase is planar or generally planar. By "planar" we mean that the upper surface has a substantially continuous profile, and does not contain any unfilled cavities. The upper surface may, however, be rough due to the granular nature of the composition from which the first phase is formed. The upper surface may be flat, optionally with chamfered edges, or may have a gently rounded appearance. For example, the upper surface may be slightly convex or concave. Preferably the surface is slightly concave to accommodate the glue. If the upper surface is not flat, the difference in heights between the highest and lowest points on the surface is desirably less than 5 mm, more desirably less than 3 mm, and preferably less than 2 mm or 1 mm.

The second phase is prepared separately from the first phase. It may also be formed by compression, for example from a powdery or granulated composition, or by extrusion or injection moulding. The second phase may also be a non-compressed phase, for example prepared by gelling a liquid composition with a gelling agent, or by solidifying a melt of the desired components. The second phase may also comprise one or more portions of differing compositions. The shape of the lower surface of the second phase is planar or generally planar, and ideally matches the upper surface of the first phase to ensure that they can adhere to each other. For example, the two surfaces can both be flat, or the upper surface of the first phase may be convex and the lower surface of the second phase may be concave respectively or vice versa.

The remaining surfaces of the first and second phases may be of any desired shape. The second phase may have, for example, a cross-section which is circular, ellipsoidal or rectangular. For example, the second phase may be in the form of a segment of a sphere or ellipsoid, the flat portion of said segment being adhered to said upper surface. The second phase may be a complete hemisphere, or a smaller segment. Desirably the second segment does not have sharp edges or corners, to avoid damage and abrasion during transport and storage.

The present invention further provides a multi-phase detergent tablet comprising:

a) a first phase having an upper surface, and b) a second phase carried by a portion of said upper surface, wherein that portion and the remaining portion of the upper surface together form a continuous profile.

The tablet may comprise a single second phase, or two or more second phases, which may be of the same or different shapes and/or have the same or different compositions. The two or more second phases may both be on the upper surface of the first phase, or on different surfaces, such as the upper surface and lower surface. One second phase is preferred.

The first phase and the second phase are adhered together, for example by an adhesive. An adhesive may be applied to the first phase, the second phase, or both phases. A suitable adhesive is, for example, a polyethylene glycol.

The first phase will generally be present in the tablet in a greater amount than the second phase. For example, the weight ratio of the first phase to the second phase is generally greater than 1:1, preferably greater than 4:1, more preferably greater than 8:1, and even more preferably greater than 10:1.

The second phase partially covers the upper surface of the first phase. For example, in terms of surface area, it may cover 10 to 50% of the upper surface, especially 15 to 30%.

The tablet will comprise components suitable for use in detergent tablets. Thus either or both of the first phase and the second phase suitably comprises detergent components such as surfactants, builders, enzymes, bleaching agents, bleach enhancers, alkalinity sources, colourants, fragrances, polymers, crystal growth inhibitors, heavy metal ion sequestrants, salts, fillers, enzyme stabilisers, corrosion inhibitors, suds suppressors, solvents, fabric softener agents, optical brighteners, hydrotropes and/or gelling agents. Such components are well known to those skilled in the art. Reference is made, for example, to GB-A-2,339,790, WO 99/40171, EP-A-481,793 and WO 99/35234.

Desirably the second phase comprises a component which is intended to be released before the components of the first phase. Thus, for example, it may comprise enzymes. It may also comprise bleaching agents and/or bleach enhancers. In order to achieve a quicker dissolution of the second phase in the wash, if this is desired, the second phase may be only slightly compressed, or may be in non-compressed form such as a gel. The second phase may also comprise a disrupting agent, for example a mixture of compounds such as an acid and a base which effervesces when in the presence of water. A suitable disrupting agent is a mixture of an acid such as citric acid and a carbonate or bicarbonate such as sodium carbonate or sodium bicarbonate.

The detergent tablets of the present invention may be formulated for use as, for example, water softening tablets, washing tablets for laundry or dishwasher tablets. The tablets can be used in a washing machine or dishwasher as appropriate in a conventional manner.

FIG. 1 is a side view of an embodiment of a tablet of the present invention suitable for use in an automatic dishwashing machine.

Figure 2:
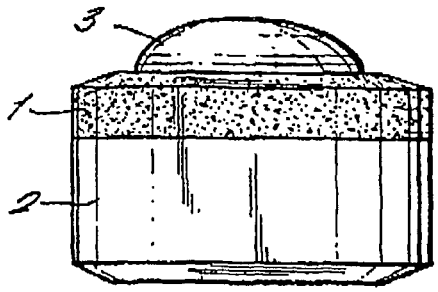
Figure 3:
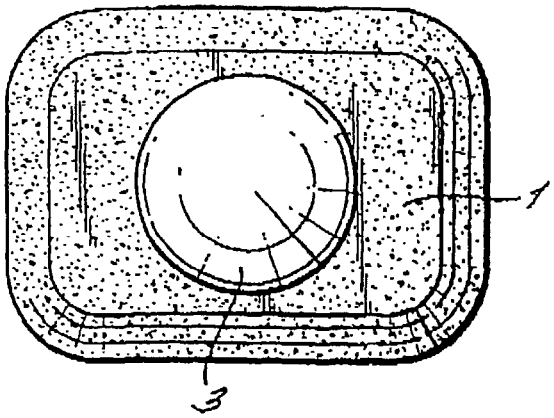
Figure 4:
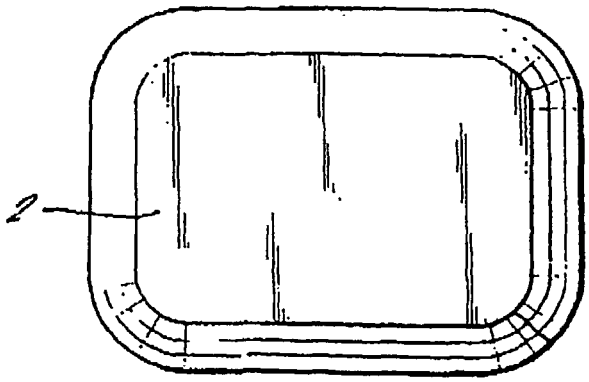

FIGS. 2, 3 and 4 show the same tablet in side, upper plan and lower plan views. The tablet has a first phase consisting of an upper layer (1) and a lower layer (2). The layers are desirably of different colours. For example the upper layer (1) is light blue and the lower layer (2) is white. The top of the upper layer (1) and the bottom of the lower layer (2) are both flat, although the edges have been chamfered to remove the sharp edges and corners to help prevent damage during storage and transportation.

The tablet also comprises a second phase (3). This takes the general form of a segment of a sphere and is adhered to the upper surface of the first layer (1) by an adhesive (not shown). However, in order to assist moulding of the first phase, and again in order to reduce damage to the second phase (3) before it is adhered to the first phase, the edges of the upper surface of the second phase (3) are made slightly steeper than a true spheroidal surface to reduce the possibility of damage before it is adhered to the upper layer (1). The second phase (3) is desirably coloured in a different colour from the first phase. For example it may be coloured red.

Each phase or multi-layered phase may be manufactured by using any compacting process, such as tabletting, briquetting, or extrusion, preferably tabletting. Suitable equipment includes a standard single stroke or a rotary press (such as Courtoy(R) , Korsch(R) , Manesty(R) , or Bonals(R)).

The first phase prepared according to this invention preferably have a width or length of between 20 mm and 80 mm, preferably of at least 35 and up to 65 mm, and a weight between 5 and 100 g. The ratio of height to diameter (or width) of the tablets is preferably greater than 1:3, more preferably greater than 1:2. The compaction pressure used for preparing these tablets need not exceed 120,000 kN/m$^2$, preferably not exceed 90,000 kN/m$^2$, more preferably not exceed 85,000 kN/m$^2$, even more preferably not exceed 70,000 kN/m$^2$ and most preferably not exceed 50,000 kN/m$^2$.

The second phase is smaller than the first phase the compaction pressure can be of a similar value.

Multi-layer phases can be made by known techniques.

EXAMPLES WATER SOFTENING TABLETS

The pills (second phase) were made into hemispheres by pressing separately with a rotary Fette press and subsequently assembled onto blue/white layer tablets (first phase).

The tablets are pressed with a rotary Korsch press (speed around 400–450 tabs/minute) and the pills are glued onto top (a nozzle puts a drop of glue in the centre of the tab and the pills collected by a sorter are then positioned onto it); depending on the possibility of flipping the tabs, pills can be glued either on the blue or the white layer. Tablets with pills are then foiled and put in a cardboard box.

| Raw Materials | White Layer | Blue Layer | Pill | Total |
|---|---|---|---|---|
| Tri-Sodium Citrate | 52.73 | 62.89 | 39 | 54.83 |
| Polymer | 24.75 | 24.75 | | 22.89 |
| Polyethylene glycol | 3 | 3 | 3 | 3.00 |
| Lubricant | 7.0 | 7.0 | 20.5 | 8.02 |
| Filler | 12.52 | | 29.24 | 9.92 |
| Layer silicate | | 2 | | 0.62 |
| Colour | | 0.36 | | 0.11 |
| Phosphonate | | | 5.36 | 0.40 |
| Silica | | | 2.1 | 0.16 |
| Colour | | | 0.8 | 0.06 |
| Total | 100 | 100 | 100 | 100 |
| Tri-Sodium Citrate | 52.73 | 62.89 | 40 | 54.90 |
| Polymer | 24.75 | 24.75 | 1 | 22.97 |

-continued

| Raw Materials | White Layer | Blue Layer | Pill | Total |
|---|---|---|---|---|
| Polyethylene glycol | 3 | 3 | 3 | 3.00 |
| Microcrystalline Cellulose | 7.0 | 7.0 | 20.5 | 7.94 |
| Filler | 12.52 | | 32.1 | 7.83 |
| Layer silicate | | 2 | | 0.62 |
| Colour | | 0.36 | | 0.11 |
| Talcum | | | 1.5 | 0.11 |
| Silica | | | 1.1 | 0.08 |
| Colour | | | 0.8 | 0.06 |
| Total | 100 | 100 | 100 | 100 |

The invention claimed is:

1. A multi-phase detergent tablet comprising:

a first phase having a flat upper surface or the upper surface may be slightly convex or concave wherein the difference in heights between the highest and lowest points on the surface is less than 1 mm, and a second phase adhered to and only partially covering said upper surface, wherein the second phase is adhered to the first phase by an adhesive and the second phase adhered to the first phase covers 10% to 50% of the upper surface of the first phase.

2. A tablet according to claim 1 wherein the first phase has a flat upper surface.

3. A tablet according to claim 1 wherein the second phase is in the form of a segment of a sphere or ellipsoid, the flat portion of said segment being adhered to said upper surface.

4. A tablet according to claim 1 wherein the first phase comprises two or more layers of differing compositions.

5. A tablet according to claim 1 wherein the second phase comprises an enzyme.

6. A tablet according to claim 1 wherein the second phase comprises a bleach enhancer.

7. A tablet according to claim 1 wherein the second phase comprises a disrupting agent.

8. A tablet according to claim 1 wherein the first phase and the second phase are compressed.

9. A multi-phase detergent tablet according to claim 1 wherein:

the adhesive is present on the flat upper surface of the first phase to only partially cover said flat upper surface.

10. A tablet according to claim 1 wherein:

the adhesive is polyethylene glycol.

11. A tablet according to claim 1 which is a dishwasher tablet.

12. A process for the manufacture of a multi-phase detergent tablet which process comprises the steps of:

forming a first phase having a flat upper surface or the upper surface may be slightly convex or concave wherein the difference in heights between the highest and lowest points on the surface is less than 1 mm;

forming second phase separately from the first phase;

subsequently, adhering the second phase to the upper flat surface of the first phase with an adhesive wherein the second phase adhered to the first phase covers 10% to 50% of the flat upper surface of the first phase.

13. A process according to claim 12 wherein the adhesive is polyethylene glycol.

* * * * *